US010513370B1

(12) United States Patent
Goossens et al.

(10) Patent No.: US 10,513,370 B1
(45) Date of Patent: Dec. 24, 2019

(54) PRODUCT PACKAGING

(71) Applicant: Google LLC, Mountain View, CA (US)

(72) Inventors: Erik Hubert Dolly Goossens, San Francisco, CA (US); Qifeng Liang, Mountain View, CA (US); Byeong Seon Oh, San Francisco, CA (US)

(73) Assignee: GOOGLE LLC, Mountain View, CA (US)

( * ) Notice: Subject to any disclaimer, the term of this patent is extended or adjusted under 35 U.S.C. 154(b) by 0 days.

(21) Appl. No.: 15/789,317

(22) Filed: Oct. 20, 2017

Related U.S. Application Data

(60) Provisional application No. 62/411,465, filed on Oct. 21, 2016.

(51) Int. Cl.

| | |
|---|---|
| ***B65D 5/52*** | (2006.01) |
| ***B65D 5/46*** | (2006.01) |
| ***B65D 5/66*** | (2006.01) |
| ***B65D 5/50*** | (2006.01) |

(52) U.S. Cl.
CPC ..... *B65D 5/5213* (2013.01); *B65D 5/46* (2013.01); *B65D 5/5028* (2013.01); *B65D 5/66* (2013.01)

(58) Field of Classification Search
CPC ... B65D 5/38; B65D 5/44; B65D 5/46; B65D 5/50; B65D 5/5021; B65D 5/5028; B65D 5/52; B65D 5/5213; B65D 5/66
USPC ..... 206/732, 738, 739, 751–758
See application file for complete search history.

(56) References Cited

U.S. PATENT DOCUMENTS

| | | | | |
|---|---|---|---|---|
| D383,064 | S | 9/1997 | Tsukikawa | |
| 6,095,408 | A | 8/2000 | Nguyen et al. | |
| D574,230 | S | 8/2008 | Van et al. | |
| D625,598 | S | 10/2010 | Ruth et al. | |
| 7,832,563 | B2 * | 11/2010 | Dehlin | B65D 5/38 229/125.125 |
| D635,456 | S | 4/2011 | Yan | |
| 8,746,444 | B2 | 6/2014 | Dehlin et al. | |
| D726,819 | S | 4/2015 | Botha et al. | |
| 9,682,793 | B2 * | 6/2017 | Magnusson | B65D 5/38 |
| 2006/0266672 | A1 | 11/2006 | Young et al. | |
| 2006/0266812 | A1 | 11/2006 | Von et al. | |
| 2007/0251983 | A1 | 11/2007 | Freeze et al. | |
| 2008/0060975 | A1 | 3/2008 | Young et al. | |
| 2008/0314780 | A1 | 12/2008 | Weston et al. | |
| 2016/0001937 | A1 | 1/2016 | Skinner | |
| 2017/0050797 | A1 | 2/2017 | Keene et al. | |
| 2017/0060262 | A1 | 3/2017 | Hviid et al. | |
| 2017/0081098 | A1 | 3/2017 | Vercoe et al. | |
| 2017/0217658 | A1 | 8/2017 | Whitehurst et al. | |

FOREIGN PATENT DOCUMENTS

| | | | | |
|---|---|---|---|---|
| DE | 2030830 A | * 12/1971 | | B65D 5/38 |
| WO | WO-2007083151 A1 | * 7/2007 | | B65D 5/38 |

* cited by examiner

*Primary Examiner* — Bryon P Gehman
(74) *Attorney, Agent, or Firm* — Brake Hughes Bellermann LLP

(57) ABSTRACT

A product packaging includes: a sleeve forming a first opening to an interior; and a product display configured to be contained within the interior when the product packaging is in a closed state, the product display including a lid that is configured to close the first opening in the closed state, and to begin, upon the lid being pulled, extraction of the product display from the sleeve into a presentation state.

21 Claims, 4 Drawing Sheets

PRODUCT PACKAGING

CROSS-REFERENCE TO RELATED APPLICATION

This application is a non-provisional of, and claims the benefit of the filing date of, U.S. provisional application No. 62/411,465, filed on Oct. 21, 2016, and entitled "PRODUCT PACKAGING", the contents of which are hereby incorporated herein by reference.

TECHNICAL FIELD

This document relates, generally, to product packaging.

BACKGROUND

Product packaging that entirely or partially encloses a product can be used for multiple purposes. For example, the packaging can protect the product during storage or shipping; the packaging can identify what type the product is, to facilitate merchandise management and selection; and/or the packaging can provide a branding message from the manufacturer. Some forms of product packaging are designed to provide the user (e.g., a consumer or other end customer) a particular experience when opening the packaging, in an effort to enhance the person's impression of the product.

SUMMARY

In a first aspect, a product packaging includes: a sleeve forming a first opening to an interior; and a product display configured to be contained within the interior when the product packaging is in a closed state, the product display including a lid that is configured to close the first opening in the closed state, and to begin, upon the lid being pulled, extraction of the product display from the sleeve into a presentation state.

Implementations can include any or all of the following features. The product display can be a self-contained product display, and the lid can be configured for a single straight pulling action away from the first opening on the sleeve to open the lid and thereby extract the self-contained product display from the sleeve. The product display can further include a first base connected to the lid, the first base configured to have a product positioned thereon in the closed state and in the presentation state. The product packaging can further include a second opening formed in the lid, the second opening configured to hold at least one component of the product in the closed state and in the presentation state. The product packaging can further include a first member that connects the first base to the lid. The product packaging can further include a continuous sheet of material that forms at least the lid, the first base and the first member, the continuous sheet of material comprising a first portion folded to form the lid, a second portion folded to form the first base, and a third portion between the first and second portions forming the first member. The first member can define a position of the first base and the lid relative to each other such that the product display showcases the product in the presentation state. The first member can provide hinging that allows the product display to unfold from a packaged state when the product packaging is in the closed state, into the presentation state. The lid can have at least a main surface and side surfaces perpendicular to the main surface, and the first member can be configured so that: the hinging occurs at a first side of the first member that is adjacent the lid, a second side of the member that is adjacent the first base does not hinge, and one of the side surfaces of the lid abuts the first member when the product packaging is in the closed state. The product display is moved along a direction of travel when being extracted from the sleeve, and wherein the lid is configured so that upon extraction the lid rotates relative to the first base about a rotational axis that extends through the first member, the rotational axis orthogonal to the direction of travel. The product display can further include a second base and a second member connecting the first base and the second base to each other. As the product display is being brought into the presentation state, the lid and the first base can be configured to undergo a first rotation relative to each other, and the first and second bases can be configured to undergo a second rotation relative to each other, the first and second rotations being in opposite directions. The product packaging can further include a second opening in the first base, and a door configured to partially close the second opening and clamp at least a portion of the product so as to secure the product to the first base. The product packaging can further include a buffer on an inside surface of the sleeve, the buffer configured to hold the product in place while the product packaging is in the closed state.

In a second aspect, a product packaging includes: a sleeve forming a first opening to an interior; and a product display configured to be contained within the interior when the product packaging is in a closed state, the product display including means for closing the first opening in the closed state, and for extracting the product display from the sleeve into a presentation state.

Implementations can include any or all of the following features. The product display can be configured to be extracted from the sleeve in a seamless unfolding manner. The product packaging can further include a buffer on an inside surface of the sleeve, the buffer forming a stop for the lid when the product packaging is in the closed state. The lid can include a handle, and the product display can be configured to be removed from the interior of the sleeve and placed in the presentation state by way of a user grasping the handle and pulling the lid in a direction away from the sleeve. The sleeve can further include a wall that covers an end of the sleeve that is opposite to the first opening. The sleeve can be a rectilinear container with five walls. The product display can be configured so that a footprint of the product display in the presentation state is larger than a footprint of the sleeve.

DETAILED DESCRIPTION

This document describes examples of product packaging that can provide an attractive product display when opened. In some implementations, a user employs a single straight pulling action to open a side lid of the packaging and thereby extract a self-contained product display from the packaging. In some implementations, the lid can serve to close an opening in the product packaging when the product packaging is in a closed state, and/or can serve to extract the product display from the product packaging, such that the product display assumes a presentation state. For example, the product display can be extracted from the packaging in a seamless unfolding manner, which can give the extracted display a larger footprint than the packaging had before the unfolding. This can help showcase the product and any components thereof to a user, for instance if they are handling the product for the first time.

Figure 1:
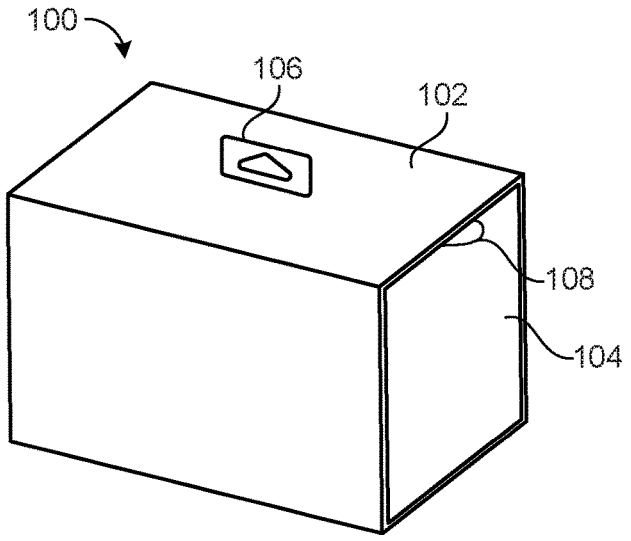
FIG. 1 shows an example of product packaging.

FIG. 1 shows an example of product packaging 100. Here, the product packaging includes a sleeve 102 having at least one opening toward its interior, the opening currently covered by a lid 104. In some implementations, the lid 104 can serve to close the opening in the sleeve 102 when the product packaging 100 is in a closed state, for example as shown here, and/or can serve to extract a product display from the product packaging 100, such that the product display assumes a presentation state. One or more hangers can be provided on the product packaging. For example, a hangtab 106 is attached to the sleeve. One or more handle mechanisms can be provided on the lid 104. For example, a tab 108 is attached to the lid 104. In some implementations, the lid 104 is configured so that a single straight pulling action can be performed on the lid 104 in a direction away from the opening on the sleeve. For example, such a single straight pulling action can involve pulling on the lid 104 in essentially a single direction with a single straight and continuous motion. The single straight pulling action can serve to open the lid 104 and thereby extract a product display from the sleeve 102.

Figure 2:
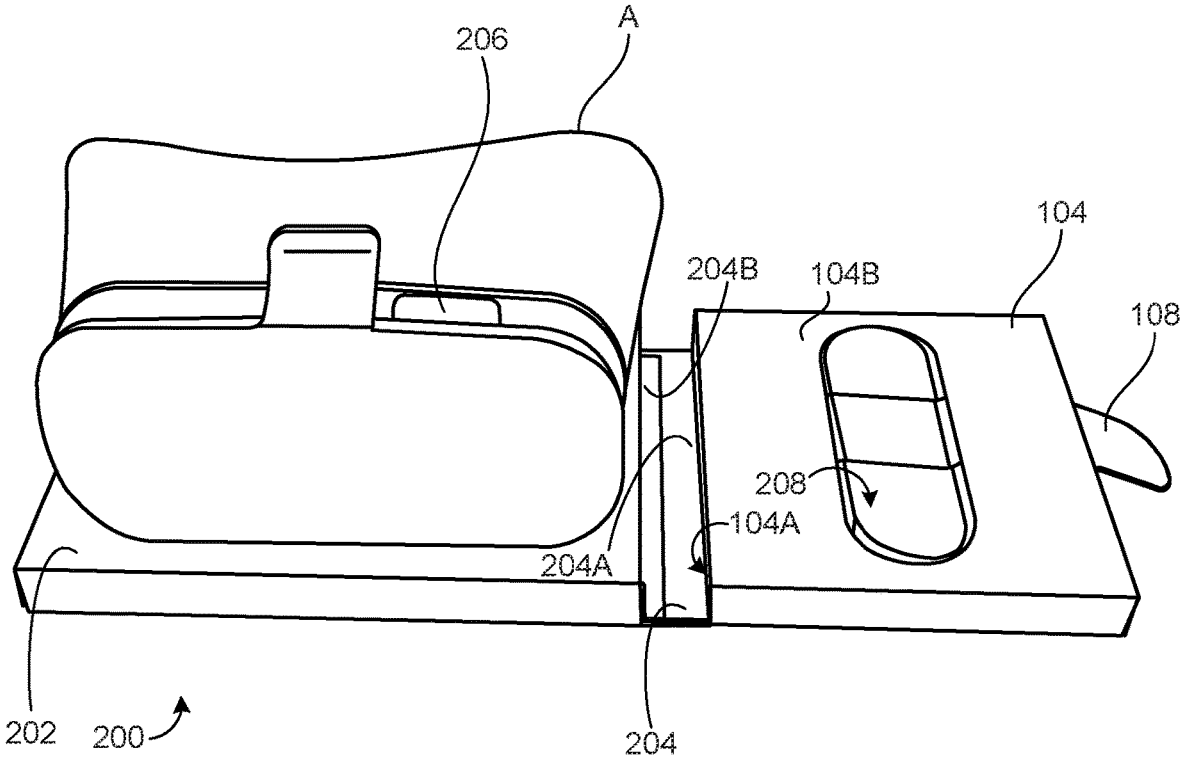
FIG. 2 shows an example of a product display that may initially have been contained within the product packaging of FIG. 1.

FIG. 2 shows an example of a product display 200 that may initially have been contained within the product packaging 100 of FIG. 1. The present configuration of the product packaging 100 can be considered a presentation state. In some implementations, the product display 200 can be entirely contained within the sleeve 102 (FIG. 1) when the product packaging 100 is in a closed state (for example, as shown in FIG. 1). For example, no part of the product display 200 may extend beyond a perimeter of the sleeve 102. In some implementations, the product display 200 can be essentially contained within the sleeve 102 (FIG. 1) when the product packaging 100 is in a closed state. For example, only a minor aspect of the product display 200 may extend beyond the perimeter of the sleeve 102, whereas most of the product display 200 does not extend beyond the perimeter of the sleeve 102. The product display here includes the lid 104, which is currently positioned face down onto the underlying surface, as a result of being pulled by the tab 108. That is, the lid 104 can include a handle such as the tab 108, and the product display 200 may be configured to be removed from the interior of the sleeve (e.g., FIG. 1) and placed in the presentation state by way of a user grasping the handle and pulling the lid 104 in a direction away from the sleeve. The product display 200 has a base 202 on which a product A is currently positioned. The base 202 can be configured to have a product (such as the product A) positioned thereon in the closed state (e.g., as in FIG. 1) and in the presentation state (e.g., as in FIG. 2). Various implementations can be used with different types of product. Here, for example, the product A is a virtual reality headset adapted to have a personal electronic device (e.g., a smartphone) attached thereto or inserted therein. The product display 200 can be configured to be extracted from the sleeve in a seamless unfolding manner. For example, the lid 104 and the base 202 can be angled relative to each other in the closed state, and the seamless unfolding can involve a continuous relative rotation between them, such as by the lid 104 rotating relative to the base 202.

The lid 104 and the base 202 can be joined to each other in various ways. Here, a member 204 extends between adjacent edges of the lid and the base. That is, the lid 104 and the base 202 can be connected to each other by at least the member 204. In some implementations, the member 204 can define a position of the base 202 and the lid 104 relative to each other. For example, the product display 200 can showcase the product A in the presentation state, such as in the manner illustrated.

In some implementations, the lid 104 and the base 202 may each have been formed from a continuous sheet of material (e.g., carton). The continuous sheet of material can include a first portion folded to form the lid 104, a second portion folded to form the base 202, and a third portion between the first and second portions forming the member 204. For example, when a first portion of the sheet is folded to form the lid, and a second portion thereof is folded to form the base, a third portion of the sheet between the lid and the base can remain unaffected by the folding so as to form the member 204. As other examples, the member 204 can be a separate element that is attached to the lid and the base, or can be integral to either of them and then attached to the other one during assembly.

When the lid 104 is pulled away from the sleeve 102 (FIG. 1), the member 204 can provide hinging that allows the product display to unfold from its packaged state (e.g., as shown in FIG. 1) into a presentation state (e.g., as shown in FIG. 2). For example, the member 204 can provide hinging that allows the product display 200 to unfold from a packaged state as shown in FIG. 1 when the product packaging is in the closed state, into the presentation state shown in FIG. 2. In some implementations, hinging occurs near where the member meets the lid, whereas an opposite side of the member near the base does not hinge. The lid 104 can have side surfaces 104A that surround, and are perpendicular to, a main surface 104B. The member 204 can be configured so that the hinging occurs at a first side 204A of the member 204 that is adjacent the lid 104. The member 204 can be configured so that a second side 204B of the member 204 that is adjacent the base 202 does not hinge, The member 204 can be configured so that one of the side surfaces 104A of the lid 104 abuts the member 204 when the product display 200 is in the closed state. Here, the one of the side surfaces 104A that is marked by the reference number "104A" will abut the member 204 in the closed state. For example, this can entail that the surface 104A of the lid faces (or abuts) the member 204 in the packaged state. In other implementations, the hinging can be done in another way, such as near the base.

A piece 206 is here inserted into the product A approximately where the smartphone/device would sit during use. In some implementations, this can help keep the product in the correct position on the product display. For example, the piece can extend to the base 202 and be attached thereto.

An opening 208 is here formed in the inside of the lid 104. In some implementations, the opening 208 is configured to hold one or more components of the product A during storage and presentation of the product display. The opening 208 can hold the component(s) of the product when the product packaging is in the closed state and when the product packaging is in the presentation state. For example, a controller for a virtual reality headset can be stored in a space formed by the opening.

Figure 3:
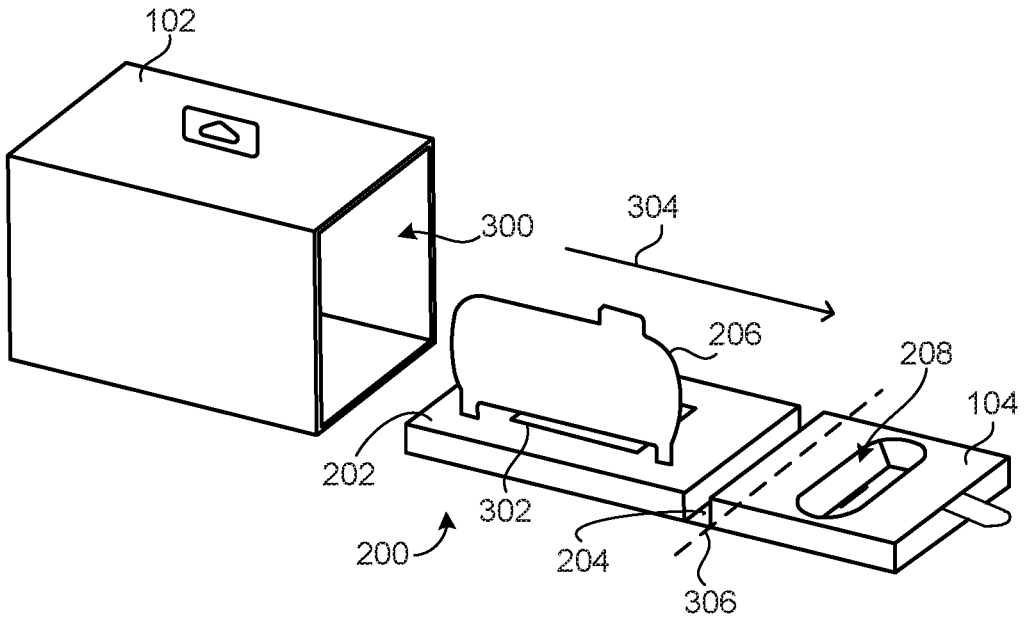
FIG. 3 shows an example of a product display having been removed from the interior of the sleeve.

FIG. 3 shows an example of the product display 200 having been removed from the interior of the sleeve 102. Upon the lid 104 being pulled, the lid 104 can begin the extraction of the product display 200 from an interior 300 of the sleeve 102. By the removal process, the product display is extracted from the sleeve and assumes the presentation state. The extraction can be considered complete when the product display 200 reaches the presentation state, such as the one shown here. In some implementations, a portion of the packaging, such as the piece 206 is intended to be removed by the user. For example, the piece 206 can have instructions printed thereon, such as a quick-start guide. Other features of the product display 200 can also or instead serve to keep the product or its components or accessories in the correct position. For example, the opening 208 in the lid 104 can hold one or more components or accessories. An opening 302 in the base 202 can be used for securing some component of the product so as to keep the product A (FIG. 2) in place.

The product display 200 can be a self-contained product display. For example, the base 202 and the lid 104 can form display surfaces that adequately accommodate the relevant product(s) and any components or accessories thereof for presentation to a prospective customer. As such, no additional stands, pedestals, holders or racks may be required beyond the self-contained product display in order to showcase the product.

In some implementations, the product display 200 can be extracted from the sleeve 102 by way of a single straight pulling action on the lid 104. In some implementations, the product display 200 is removed from the interior 300 of the sleeve 102 and placed in the presentation state by way of a user grasping a handle (e.g., a tab) on the lid 104 and pulling the lid in a direction away from the sleeve. For example, the presentation state can then include the lid and the base 202 being situated adjacent each other on an underlying surface as shown, their position relative to each other determined by the member 204. Thus, the product display in the presentation state can showcase the product and its related components or accessories (omitted here for clarity) in a way that is visually pleasant and makes it easy for the user to begin using the product. Should the user wish to put the product display back inside the sleeve, the user can push the display in the opposite direction until it is entirely within the interior of the sleeve, and close off the sleeve using the lid, similar to the closed state shown in FIG. 1. The end of the sleeve opposite to where the product packaging is extracted can be closed off, for example by way of a wall integral to the sleeve, or by an attached wall.

The product display 200 can be moved along a direction of travel 304 when being extracted from the sleeve 102. For example, the direction of travel 304 is parallel with a bottom surface of the sleeve 102. Extraction of a product display from packaging can involve rotation of a component relative to another. In some implementations, the lid 104 upon extraction rotates relative to the base 202 about an axis 306 that extends through the member 204. For example, this axis 306 can be orthogonal to the direction of travel 304. For example, this rotation axis can be essentially orthogonal to the direction of travel 304 if the angle between them is almost 90 degrees, such as being a few degrees from perpendicular. When the product packaging is being brought into the closed state, the product display 200 can be moved in a direction opposite to the direction of travel 304.

Figure 4:
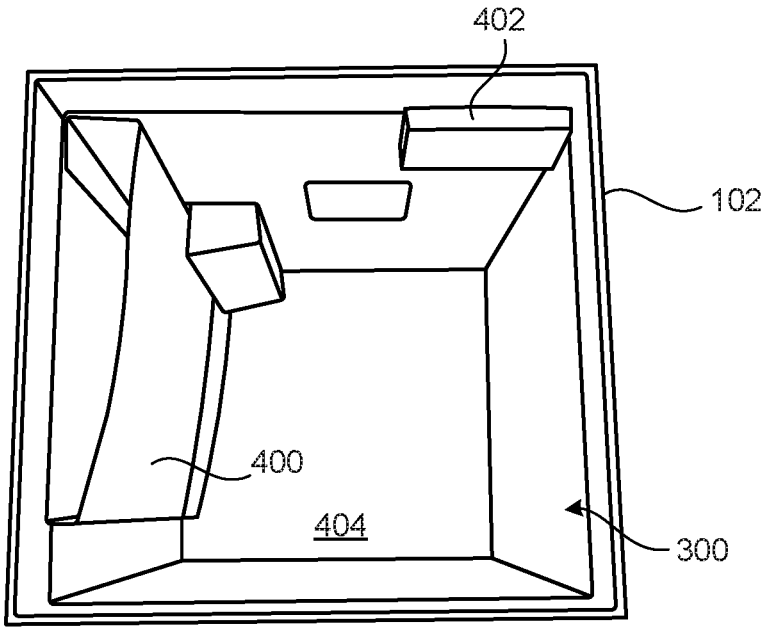
FIG. 4 shows an example of buffers inside a sleeve.

FIG. 4 shows an example of buffers inside the sleeve 102. Buffers can be positioned on surfaces inside the sleeve 102. In some implementations, the interior 300 has a first buffer 400 on an interior wall and a second buffer 402 on another interior wall. Each of the buffers has a shape than can be selected based on, for example the type of product or the shape of the packaging. For example, either or both of the buffers can serve to hold the product in place while the packaging is in the packaged state, and/or can form a stop for the lid (e.g., FIG. 3) when it is closed. For example, the buffer 400 can be configured to hold the product in place while the product packaging is in a closed state (e.g., as shown in FIG. 1). For example, the buffer 402 can be configured to form a stop for the lid (e.g., the lid 104 in FIG. 2) while the product packaging is in a closed state (e.g., as shown in FIG. 1).

In some implementations, the sleeve 102 has an end wall 404. The wall 404 can cover an end of the sleeve 102 that is opposite to the opening. In some implementations, the sleeve 102 is a rectilinear container with five walls, including the end wall 404.

Figure 5:
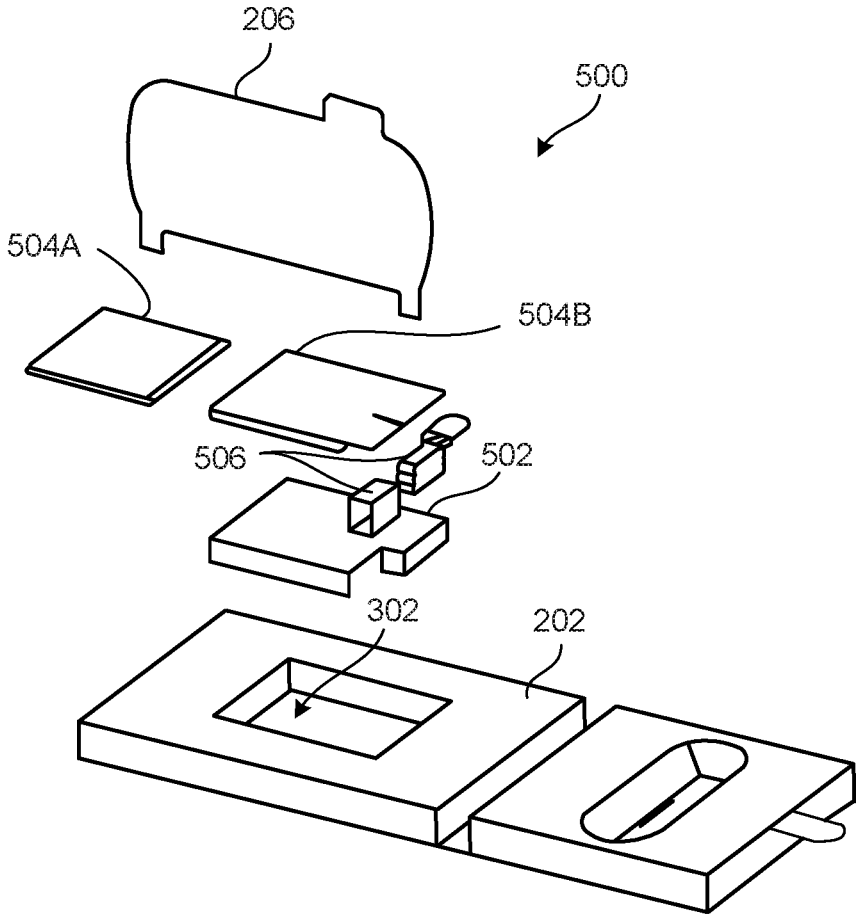
FIG. 5 shows an example of components included in a product display.

FIG. 5 shows an example of components included in the product display 200. The base 202 has the piece 206 than can be mounted thereto, such as by way of inserting tabs extending from the piece into corresponding slits or other openings in the base. Thus, the piece can extend essentially perpendicularly from the base and provide support for attaching the product.

In the opening 302 of the base 202, an assembly of components can serve to hold a product in place. Here, an insert 502 has a shape corresponding to that of the opening 302. On top of the insert, a closure is positioned that here includes a member 504A and a door 504B. For example, the member can be partially or completely inserted into the door. When in use, the door can partially close off the opening in the base and thereby clamp some portion of the product, thereby securing it to the base. In some implementations, the member 504A and/or the door 504B can be configured to at least partially close the opening 302 and thereby clamp at least a portion of the product so as to secure the product to the base 202. The closure can be locked in its closed position by way of a locking mechanism. For example, a mechanism 506 includes a housing that fits within a cutout of the insert, and an actuated member that selectively engages with the closure, such as by way of a slot therein.

Referring again briefly to FIG. 1, the product packaging 100 can be made of any suitable material. In some implementations, a paper product, such as carton, is used. For example, the sleeve 102 can be created by folding a sheet of material that has been cut into a suitable shape, so that the resulting sleeve is a rectilinear container with five walls that is open towards one direction. The product display 200 (e.g., FIG. 3) can be made of the same material as the sleeve or a different material. For example, the base and the lid can be formed by folding and assembling together suitably cut portions of a common sheet of material. As another example, the piece 206 (e.g., FIG. 3) can be made from cardstock.

Figure 6A:
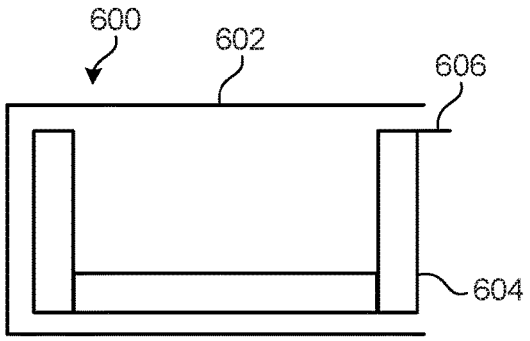
FIGS. 6A-C show examples of a product packaging.
Figure 6B:
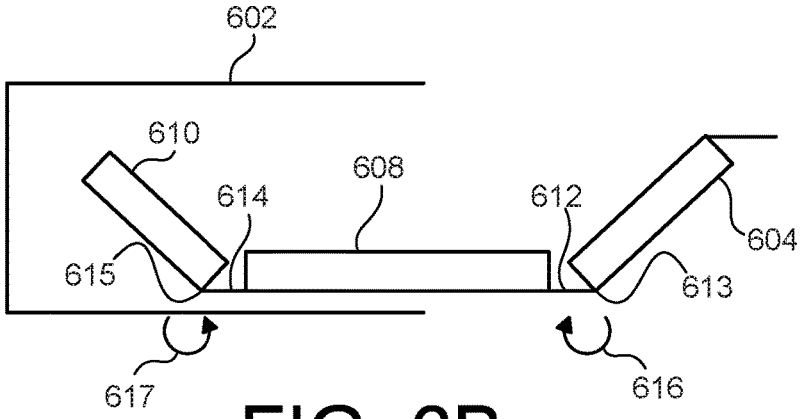
Figure 6C:
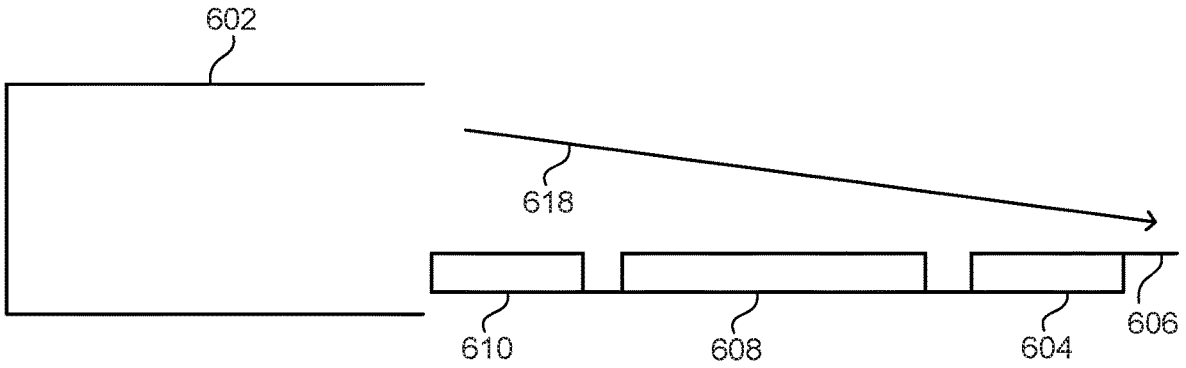

FIGS. 6A-C show examples of a product packaging 600. This conceptual illustration shows the packaging in a partially transparent state for clarity. FIG. 6A shows that the product packaging includes a sleeve 602 closed off by a lid 604, wherein the lid can be manipulated using a handle such as a tab 606. In some implementations, the lid 604 can serve to close an opening in the sleeve 602 when the product packaging 600 is in a closed state, and/or can serve to extract a product display from the product packaging 600, such that the product display assumes a presentation state.

FIG. 6B shows that the lid 604 is being pulled away from the sleeve 602, thereby beginning to unfold the product display from a closed state it had in FIG. 6A. In particular, the product display here includes the lid, a base 608 and another base 610. The lid and the base 608 are connected by a member 612. The base 608 and the base 610 are connected by a member 614. For example, the members 612 and/or 614 can be created as a result of forming the lid and/or the respective bases.

In some implementations, as the product display is being brought into the presentation state, the lid 604 and the base 608 are configured to undergo a first rotation relative to each other about a rotation axis 613 that is here perpendicular to the illustration. The rotation about the rotation axis 613 is here a clockwise rotation of the lid 604 as viewed in this illustration, as schematically illustrated by an arrow 616. The bases 608 and 610 can be configured to undergo a second rotation relative to each other about a rotation axis 615 that is here perpendicular to the illustration. The rotation about the rotation axis 615 is here a counterclockwise rotation of the other base 610 as viewed in this illustration, as schematically illustrated by an arrow 616. The first and second rotations can occur in opposite directions, for example as illustrated by the arrows 616 and 617.

FIG. 6C shows that the product assembly including the lid 604 and the bases 608 and 610 has been entirely removed from the interior of the sleeve 602 and is positioned flat on a horizontal surface. This can be considered a presentation state of the product assembly including the lid 604 and the bases 608 and 610. The product assembly can be configured to be extracted from the sleeve 602 in a seamless unfolding manner. For example, the rotations about the rotation axes 613 and 615 can be essentially continuous and the travel of the base 608 can be smooth and free of jolts or other jerky motion. The unfolding here provides the product display with a footprint that is larger than that of the sleeve 602. That is, the product display, which can be extracted from the product packaging by way of a simple continuous pulling motion, has a larger footprint in the presentation state than the packaging itself in the closed state. For example, the product display can thus make visible to the user all relevant aspects of the product so as to facilitate a complete overview of the contents thereof and make it easy to get started using the product.

In this example, both the lid 604 and the other base 610 rotate relative to the base 608 as the product display is being brought into the presentation state. The lid rotates about an axis through the member 612, and the base 610 rotates about an axis through the member 614. The rotations are here in opposite directions. For example, the rotation axes can both be essentially orthogonal to the direction that the product display is translated during unpacking.

In some implementations, the lid 604 is configured so that a single straight pulling action can be performed on the lid 604 in a direction away from the opening on the sleeve 602. Such a single straight pulling action can involve pulling on the lid 604 in essentially a single direction with a single motion. For example, an arrow 618 schematically illustrates a pull on the lid 604 (e.g., by way of grasping the tab 606 and pulling it outward). The pull illustrated by the arrow 618 can effectuate the transition from the state shown in FIG. 6A to the state shown in FIG. 6C. The single straight pulling action can serve to open the lid 604 and thereby extract the lid 604 and the bases 608 and 610 from the sleeve 602.

A number of embodiments have been described. Nevertheless, it will be understood that various modifications may be made without departing from the spirit and scope of the specification.

In addition, the logic flows depicted in the figures do not require the particular order shown, or sequential order, to achieve desirable results. In addition, other steps may be provided, or steps may be eliminated, from the described flows, and other components may be added to, or removed from, the described systems. Accordingly, other embodiments are within the scope of the following claims.

While certain features of the described implementations have been illustrated as described herein, many modifications, substitutions, changes and equivalents will now occur to those skilled in the art. It is, therefore, to be understood that appended claims are intended to cover all such modifications and changes as fall within the scope of the implementations. It should be understood that they have been presented by way of example only, not limitation, and various changes in form and details may be made. Any portion of the apparatus and/or methods described herein may be combined in any combination, except mutually exclusive combinations. The implementations described herein can include various combinations and/or sub-combinations of the functions, components and/or features of the different implementations described.

What is claimed is:

1. Product packaging comprising:

a sleeve forming a first opening to an interior; and a product display configured to be contained within the interior when the product packaging is in a closed state, the product display including a lid, the lid configured to: (i) close the first opening in the closed state, (ii) begin, upon the lid being pulled, extraction of the product display from the sleeve into a presentation state, and (iii) hold at least one component of a product in the closed state and in the presentation state.

2. The product packaging of claim 1, wherein the product display is a self-contained product display, and wherein the lid is configured for a single straight pulling action away from the first opening on the sleeve to open the lid and thereby extract the self-contained product display from the sleeve.

3. The product packaging of claim 1, wherein the product display further includes a first base connected to the lid, the first base configured to have the product positioned thereon in the closed state and in the presentation state.

4. The product packaging of claim 3, further comprising a second opening formed in the lid, the second opening configured to hold the at least one component of the product in the closed state and in the presentation state.

5. The product packaging of claim 3, further comprising a first member that connects the first base to the lid.

6. The product packaging of claim 5, further comprising a continuous sheet of material that forms at least the lid, the first base and the first member, the continuous sheet of material comprising a first portion folded to form the lid, a second portion folded to form the first base, and a third portion between the first and second portions forming the first member.

7. The product packaging of claim 5, wherein the first member defines a position of the first base and the lid relative to each other such that the product display showcases the product in the presentation state.

8. The product packaging of claim 5, wherein the first member provides hinging that allows the product display to unfold from a packaged state when the product packaging is in the closed state, into the presentation state.

9. The product packaging of claim 8, wherein the lid has at least a main surface and side surfaces perpendicular to the main surface, wherein the first member is configured so that: the hinging occurs at a first side of the first member that is adjacent the lid, a second side of the member that is adjacent the first base does not hinge, and one of the side surfaces of the lid abuts the first member when the product packaging is in the closed state.

10. The product packaging of claim 5, wherein the product display is moved along a direction of travel when being extracted from the sleeve, and wherein the lid is configured so that upon extraction the lid rotates relative to the first base about a rotational axis that extends through the first member, the rotational axis orthogonal to the direction of travel.

11. The product packaging of claim 5, wherein the product display further comprises a second base and a second member connecting the first base and the second base to each other.

12. The product packaging of claim 11, wherein, as the product display is being brought into the presentation state, the lid and the first base are configured to undergo a first rotation relative to each other, and the first and second bases are configured to undergo a second rotation relative to each other, the first and second rotations being in opposite directions.

13. The product packaging of claim 3, further comprising a second opening in the first base, and a door configured to partially close the second opening and clamp at least a portion of the product so as to secure the product to the first base.

14. The product packaging of claim 3, further comprising a buffer on an inside surface of the sleeve, the buffer configured to hold the product in place while the product packaging is in the closed state.

15. Product packaging comprising:

a sleeve forming a first opening to an interior; and a product display configured to be contained within the interior when the product packaging is in a closed state, the product display including lid means, the lid means being for: (i) closing the first opening in the closed state, (ii) extracting the product display from the sleeve into a presentation state, and (iii) holding at least one component of a product in the closed state and in the presentation state.

16. The product packaging of claim 15, wherein the product display is configured to be extracted from the sleeve in a seamless unfolding manner.

17. The product packaging of claim 15, further comprising a buffer on an inside surface of the sleeve, the buffer forming a stop for the lid when the product packaging is in the closed state.

18. The product packaging of claim 15, wherein the lid means includes a handle, and wherein the product display is configured to be removed from the interior of the sleeve and placed in the presentation state by way of a user grasping the handle and pulling the lid means in a direction away from the sleeve.

19. The product packaging of claim 15, wherein the sleeve further comprises a wall that covers an end of the sleeve that is opposite to the first opening.

20. The product packaging of claim 19, wherein the sleeve is a rectilinear container with five walls.

21. The product packaging of claim 15, wherein the product display is configured so that a footprint of the product display in the presentation state is larger than a footprint of the sleeve.

* * * * *